United States Patent [19]

Price et al.

[11] 3,989,059

[45] Nov. 2, 1976

[54] SUPPORT FOR INTERCONNECTION HOSE

[75] Inventors: Albert E. Price, Brookfield; Erling Mowatt-Larssen, Warren, both of Ohio

[73] Assignee: General American Transportation Corporation, Chicago, Ill.

[22] Filed: Apr. 28, 1975

[21] Appl. No.: 571,909

[52] U.S. Cl. ..... 137/347; 137/575

[51] Int. Cl.[2] ..... B61D 5/02

[58] Field of Search ..... 137/347, 575; 214/41, 214/83.26, 83.28

[56] References Cited

UNITED STATES PATENTS

| | | | |
|---|---|---|---|
| 3,052,908 | 9/1962 | Daneman | 214/83.28 X |
| 3,613,915 | 10/1971 | Vita | 214/83.28 X |
| 3,675,670 | 7/1972 | Ogawa | 137/575 X |
| 3,897,807 | 8/1975 | Hurst et al. | 137/575 X |

*Primary Examiner*—Robert G. Nilson

*Attorney, Agent, or Firm*—Prangley, Dithmar, Vogel, Sandler & Stotland

[57] ABSTRACT

A railway train includes a plurality of interconnected tank cars, each car comprising a tank provided with two lading conduits in the top thereof extending thereinto for communication with the interior thereof and each having an outer end extending above the tank, and toward the adjacent end thereof, the lading conduits of adjacent cars being interconnected by flexible connecting conduits. A crane is pivotally mounted on the top of one of the lading conduits on each car for maintaining the associated flexible connecting conduit at an elevation higher than that of the associated conduit coupling means to cause drainage of all the lading from the flexible conduit into the associated tanks.

12 Claims, 11 Drawing Figures

FIG. 4
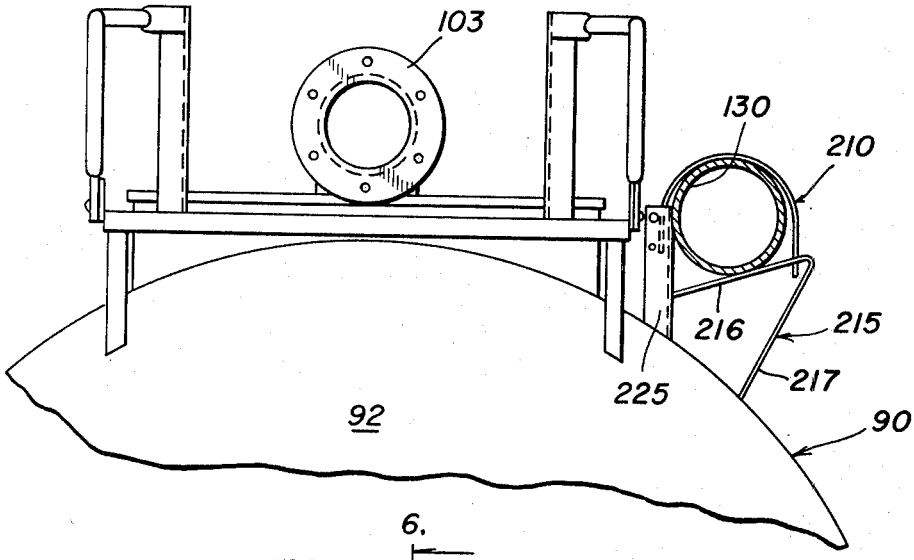
FIG. 5
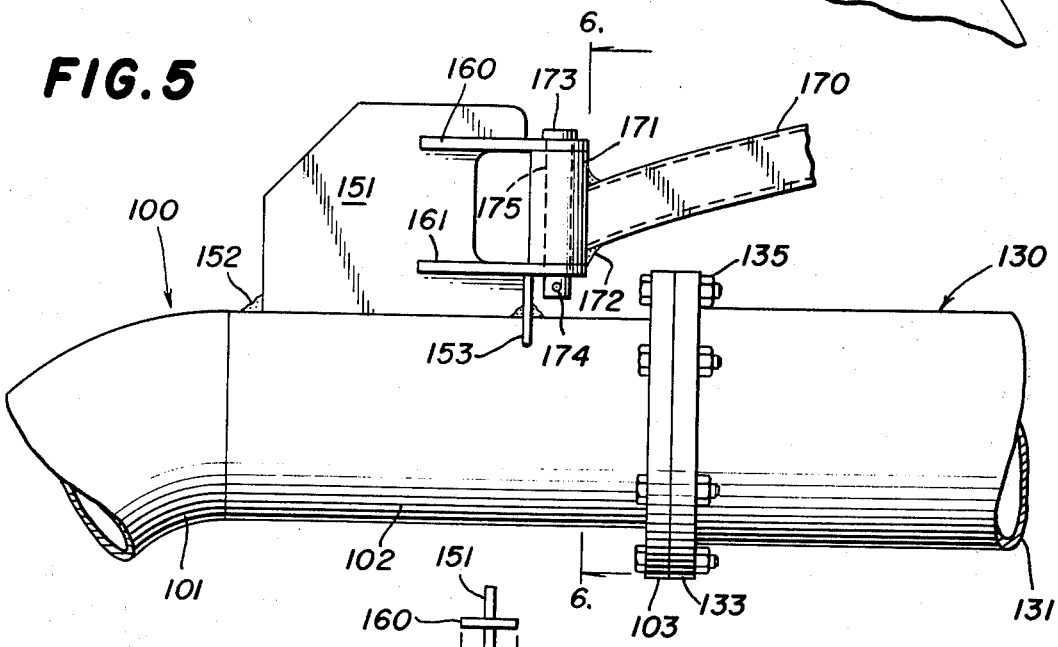
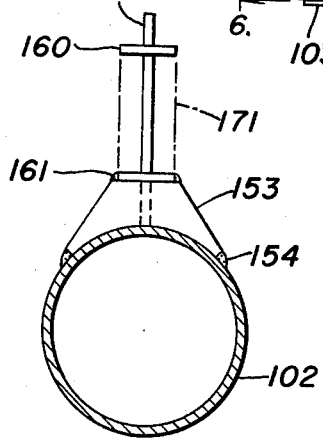
FIG. 6

SUPPORT FOR INTERCONNECTION HOSE

CROSS REFERENCE TO RELATED APPLICATIONS

This application is an improvement of application Ser. No. 403,828, filed Oct. 5, 1973, for MANIFOLDED TANK CARS FOR UNIT TRAIN SERVICE now U.S. Pat. No. 3,897,807.

BACKGROUND OF THE INVENTION

The present invention relates to railway tank cars, and in particular, to manifolded tank cars which may be interconnected to accommodate loading or unloading of the entire group of interconnected cars without movement thereof from a single point, thereby accommodating consecutive loading, transporting and unloading of fluid ladings and facilitating the formation of unit trains.

Individual tank cars are interconnected by flexible conduits or hoses which provide interconnection and communication between the insides of adjacent tank cars. During movement of the train, the flexible hoses are subjected to considerable swaying motions due to normal track irregularities as well as sharp turns and steep grades.

Preferably none of the liquid lading is stored outside of the tank cars during transit of the train to the destination point. To this end, it is advantageous to support the flexible conduit at a level above the associated connections to the adjacent tank cars resulting in drainage of the lading from the flexible conduit into the adjacent tank cars.

SUMMARY OF THE INVENTION

The present invention provides a railway tank car for unit train service, including a crane for maintaining flexible conduits interconnecting adjacent tank cars at an elevation higher than the associated connections on the adjacent tank cars, and more particularly provides a train of such cars and cranes which accommodates consecutive loading, transportation and unloading of liquid ladings, all in safety and with improved economy of time and manpower.

It is an important object of the present invention to provide a tank car of the character described, which includes a tank having two lading conduits respectively coupled thereto adjacent to the opposite ends thereof in fluid communication therewith and each extending outwardly from adjacent to the top thereof, conduit coupling means on each of the lading conduits for coupling at the top of the tank to an adjacent end of an associated flexible connecting conduit to place the tank in fluid communication with the tanks of adjacent like tank cars, and a crane mounted on one of the tanks for maintaining the flexible connecting conduit at an elevation higher than that of the associated conduit coupling means to cause drainage of all the liquid lading from the flexible connecting conduits.

In connection with the foregoing object, it is another object of this invention to provide a railway tank car of the type set forth, wherein the crane is pivotally mounted at one end thereof for movement between a first position wherein the other end of the crane extends toward the adjacent coupled tank car and supports the flexible conduit during movement of the coupled tank cars and a second position wherein the crane overlies the one tank and positions the flexible conduit for storage.

A further object of the present invention is to provide a railway tank car of the type set forth wherein spaced-apart pivotally mounted clamps maintain the flexible conduit in the storage position thereof and lock pin assemblies are provided for each clamp to insure that the flexible conduit is maintained in its storage position.

Further features of the invention pertain to the particular arrangement of the parts of the railway tank cars and the railway trains formed thereby whereby the above-outlined and additional operating features thereof are attained.

BRIEF DESCRIPTION OF THE DRAWINGS

FIG. 4 is an end elevational view of the tank car shown in FIG. 3, wherein the flexible conduit is in the storage position;

FIG. 5 is an enlarged side elevational view of a lading conduit with the crane mounted thereon;

FIG. 6 is an end elevational view, partly in section, of the crane and lading conduit, shown in FIG. 5, as viewed along the lines 6—6 thereof;

DESCRIPTION OF THE PREFERRED EMBODIMENT

Figure 1:
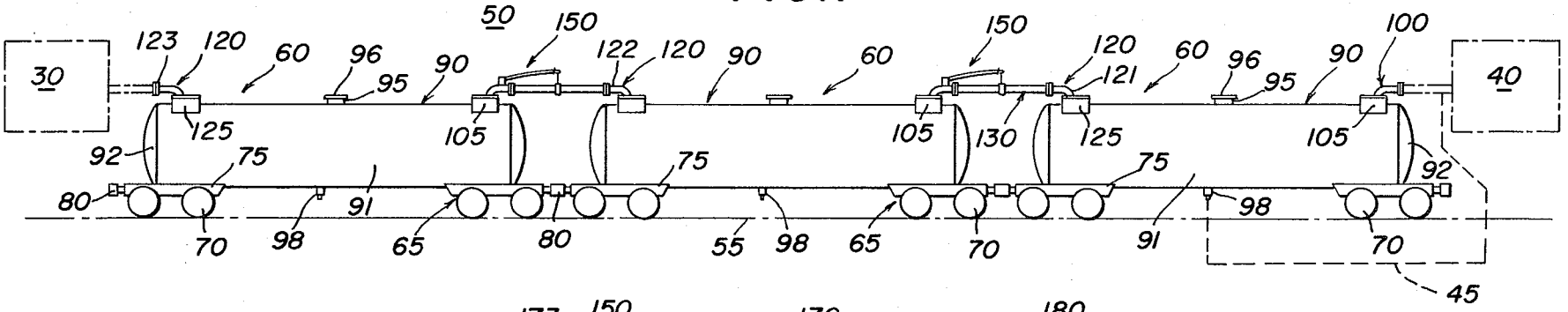
FIG. 1 is a side elevational view of a railway train comprising three railway tank cars constructed in accordance with and embodying the features of the present invention.

Referring now to the drawings, there is disclosed a train 50 comprised of three individual tank cars 60, each having truck structure 65 respectively disposed at the opposite ends thereof. Each of the truck structures 65 is provided with pairs of rail wheels 70 for rolling engagement with the rails of a standard railway track 55. Each tank car 60 is provided with a coupler 80 at each end thereof for coupling adjacent tank cars 60 together in tandem relationship. Mounted on each of the truck structures 65 is a longitudinally extending center sill 75 for supporting thereon one end of an associated tank 90, all in a well-known manner.

The tank 90 includes a tank body 91, in the form of a generally cylindrical side wall or shell, with the longitudinal axis thereof disposed in use substantially horizontally, the tank body 91 being provided with dome-shaped tank heads 92 respectively placed at the ends of the tank body 91 to form a completely enclosed liquid lading compartment. Formed in the top of the cylindrical tank body 91, substantially midway between the ends thereof, is a cylindrical manway 95 extending substantially vertically upwardly from the tank body 91 and being closed at the upper end thereof by a manway cover 96. Connected to the bottom of the tank body 91, generally midway between the ends thereof, is a loading, or unloading, assembly 98, all in a well-known manner.

Each tank 90 is provided with an inlet conduit 100, which includes a curved pipe section 101 or elbow extending downwardly through an aperture in the top of the tank body 91 and a straight pipe section 102 extending outwardly from the curved section 101 vertically spaced from the top of the tank body 91 and generally extending parallel thereto. A coupling flange 103 is positioned at the outer terminal end of the straight pipe section 102. A protective housing 105 surrounds the inlet conduit 100 and protects the same. A valve (not shown) is positioned in the inlet conduit 100 for interrupting communication between the outside of the tank car 60 and the tank 90, the valve being provided with a valve actuator (not shown) and a valve indicator 107 formed of a straight bar 108 and paddles 109 at each end thereof to indicate whether the valve is open or closed.

Each of the tank cars 60 is further provided with an outlet conduit 120, each of which includes a curved pipe section 121 or elbow extending into the tank 90 through a suitable aperture in the top thereof to provide communication between the inside of the tank and the outlet conduit 120. A straight pipe section 122 is connected to the curved pipe section 121 and is vertically displaced from the top of the tank 90 and extends generally parallel thereto and terminates in a flange 123. A protective housing 125 surrounds the outlet conduit 120 in the same manner as the housing 105. A valve (not shown) is positioned in conduit 120 for interrupting communication between the inside of the tank 90 and the outside of the tank 90 in the same manner as set forth above for conduit 100.

The outlet conduit 120 of a selected one tank car 60 is connected to the inlet conduit 100 of an adjacent tank car 60 by means of a flexible connecting conduit 130 comprised of a tubular hose 131 provided with flanges 133 on each end thereof. Each of the flanges 133 is connected to an associated flange 123 of the outlet conduit 120 or an associated flange 103 of the inlet conduit 100 by suitable connectors 135, thereby to interconnect adjacent tank cars 60 of the train 50. MOunted on each of the straight pipe sections 102 of each inlet conduit 100 is a crane 150. The crane 150 includes an arm 170 pivotally mounted to a vertical upstanding plate 151 connected to the associated straight pipe section 102, as by welds 152. A transversely positioned plate 153, as shown particularly in FIG. 6, is fixedly connected to the straight pipe section 102, as by welds 154, the plate 153 being integral with the plate 151. Two spaced apart horizontally extending plates 160 and 161 are fixedly connected to the vertically extending plate 151 to form a clevis.

The arm 170 has a hollow cylindrical member 171 welded, as at 172, at one end thereof, which member 171 fits between the clevis plates 160 and 161 to accommodate a hinge pin 175 having an enlarged head 173 at one end thereof and provided with a cotter pin 174 at the other end thereof. It is seen, therefore, that the arm 170 of the crane 150 is pivotally mounted on an associated inlet conduit 100 by means of the above-mentioned supporting structure. The arm 170 is generally arcuate in shape and is provided with an attachment member 180 at the end thereof opposite to the cylindrical member 171. The attachment member 180 includes a flange 181 and a link 182 loosely held and extending downwardly.

Figure 2:
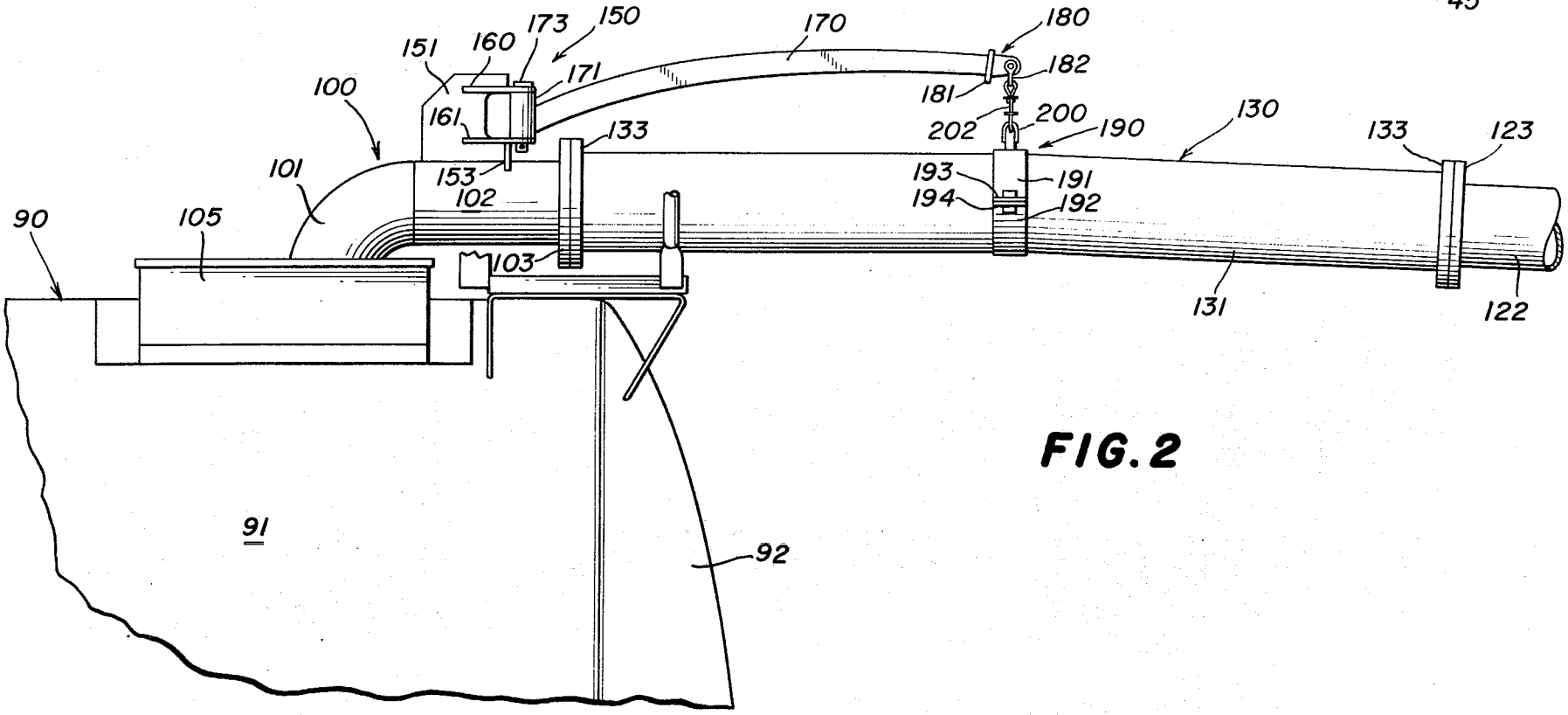
FIG. 2 is an enlarged side elevational view of one end of a tank car showing the crane in the first position thereof supporting the flexible interconnecting conduit at an elevation above the associated coupling means.

The flexible conduit 130 is provided with a coupling ring 190 positioned substantially midway between the flanges 133 at the ends of the conduit 130. The coupling ring 190 is comprised of two halves 191 and 192 having flanges 193 and 194 extending outwardly therefrom, respectively. The flanges 193 and 194 are held together by suitable connectors 195 so as to form the coupling ring 190 fixedly secured to the flexible conduit 130 substantially at the midpoint thereof. A cable 202 is pivotally mounted on a link 200 at the top of the coupler half 191, the cable 202 being swingably attached to the link 182 of the attachment member 180, thereby to form a swinging connection between the crane 150 and the flexible conduit 130. The arm 170 and the attachment member 180 are so constructed and arranged to maintain the center of the flexible conduit 130 above the adjacent couplings of the associated inlet conduit 100 and outlet conduit 120, as seen in FIG. 2. Each of the railway tank cars 60 is provided with a storage structure which includes spaced-apart clamps 210 pivotally mounted on the top of the associated tank body 91 by pins 211. More specifically, as seen in FIGS. 7 to 11, the clamps 210 each are comprised of a substantially rigid arcuate member each having a tapered end 212 and each being pivotally mounted as at 211 at the other end thereof. Each of the clamps 210 cooperates with an individual support structure 215, there being two support structures 215, each in registry with a respective one of the clamps 210. Each of the support structures 215 includes a surface 216 inclined upwardly and outwardly and joined to a support leg 217, the inclined surface 216 being provided with a slot 218 at the outer end thereof and being provided with an inner and 219 having beveled edges.

The support structures 215 are mounted in use on both the tank 90 and on an upstanding mounting member 225 which is fixedly mounted on the tank 90. Each of the mounting members 225 is U-shaped in transverse cross section and includes spaced-apart legs 226 interconnected by a bight 227. Each of the legs 226 is provided with an inclined end edge 228 which is fixedly mounted to the tank 90 as by welding. Each of the legs 226 of the mounting member 225 is provided with aligned holes 231 and aligned holes 232. It should be noted that the holes 232 are in use above the holes 231 and spaced inwardly toward the bight 227, all for a purpose hereinafter set forth.

Accordingly, it is seen from the above description that there are provided two clamps 210, each of which has a beveled edge 212 adapted to fit within the slot 218 in the upwardly inclined surface 216. The clamp 210 may be pivoted to a receiving position about the pivot 211 (see FIG. 10), thereby to present an unhindered and exposed inclined surface 216 ready to receive the flexible conduit 130 thereon, and a locking position (FIG. 7) to secure the flexible conduit 130.

A locking assembly 240 includes an elongated pin shank 241 having an enlarged head 242 at one end thereof and a pair of spaced-apart clevis arms 243 at the other end thereof. Aligned apertures 244 are respectively positioned in each of the clevis arms 243. A chain 245 is welded to the head 242 of the lock pin assembly 240 and is also welded in use to the support 225.

A tongue 250 having a beveled end 251 and an aperture 252 at the other end thereof is eccentrically and pivotally mounted between the clevis arms 243 by a pin 255. Since the tongue 250 is free to move about the pivot 255 and the tongue is eccentrically mounted between the clevis arms 243, gravity will normally position the tongue perpendicularly to the longitudinal axis of the shank 241 (as seen in full line in FIG. 9) and in this position the lock pin assembly 240 is in the locking condition thereof.

In use, the clamps 210 are each pivotally mounted about the pivot pin 211 to the receiving position which can be accomplished only when the lock pin assembly 240 has been withdrawn from the aligned apertures 232, the chains 245 secured to the mounting members 225 preventing misplacement of the lock pin assemblies 240. When the two clamps 210 have been pivoted away from the respective support structures 215, the inclined surface 216 is exposed. As seen in the drawings, the inclined surface 216 extends upwardly from the edge 219 where it is fixedly mounted to the mounting member 225, thereby to insure that the flexible connector 130 when it rests on the surface 216 is urged toward the respective one of the mounting members 225.

Figure 7:
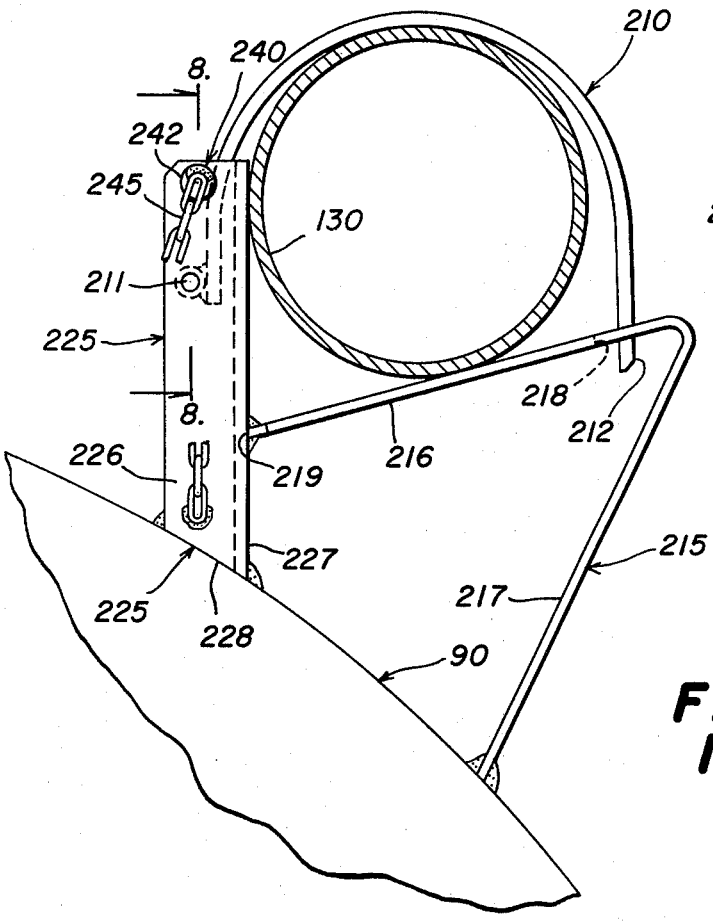
FIG. 7 is an enlarged side elevational view of the flexible conduit in the storage position thereof.
Figure 8:
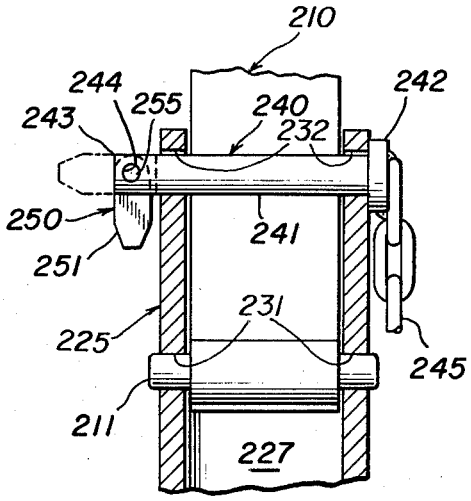
FIG. 8 is an end elevational view partly in section of the mounting mechanism illustrated in FIG. 7 as viewed along the lines 8—8 thereof.
Figure 10:
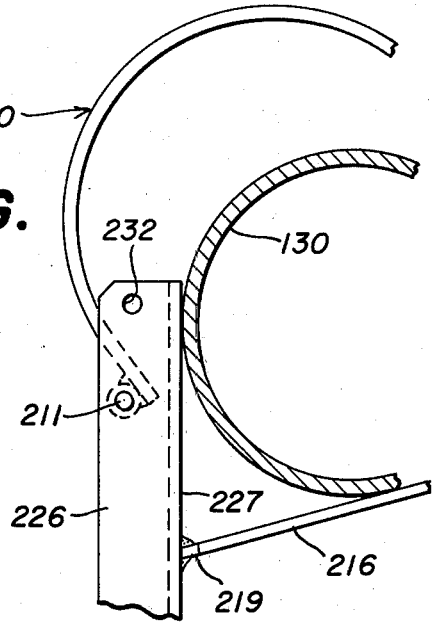
FIG. 10 is a side elevational view of a portion of the support mechanism shown in FIG. 7 with the clamp pivoted to the receiving position thereof.
Figure 9:
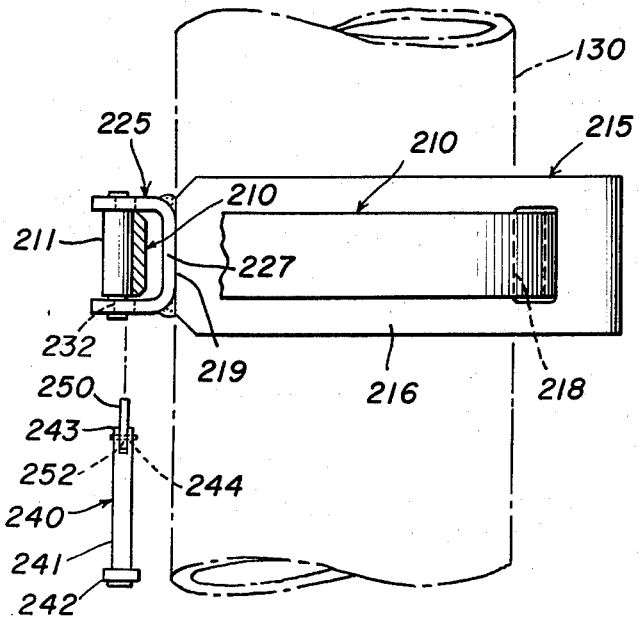
FIG. 9 is a plan view of the clamp, mounting mechanism and flexible conduit illustrated in FIG. 7 with the locking pin assembly removed.
Figure 11:
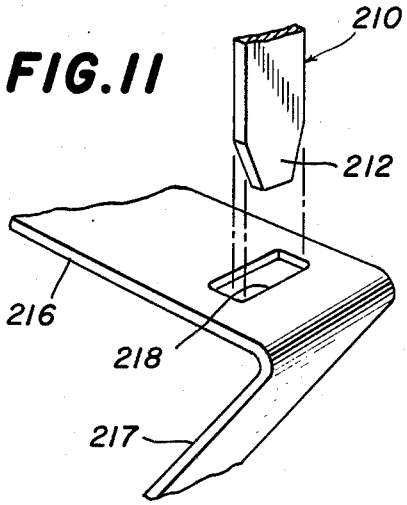
FIG. 11 is an enlarged elevational view of the end portion of the support shown in FIG. 7, particularly illustrating the engaging end of the clamp in registry with the receiving slot in the support.

After the connector 130 is placed on two support structures 215 by manipulation of the crane 150, as will be described, the two clamps 210 are moved to the locking positions thereof by pivoting the clamps about the pins 211 so that the beveled ends 212 are inserted through the respective slots 218 in the surfaces 216, as seen in FIGS. 7 and 11.

Although the clamps 210 are rigid they are somewhat resilient and bear against the outside of each of the slots 218, thereby frictionally contacting the support structures 215. To insure that the clamps 210 do not disengage from the support structures 215 during transit of the train, the lock pin assemblies 240 are inserted into each pair of apertures 232. Specifically, the tongue 250 is aligned with the longitudinal axis of the shank 241 (see the phantom line drawing in FIG. 8) and is inserted through the aligned apertures 232 in the legs 226 of the associated mounting member 225. After the shank 241 is fully inserted through the apertures 232, so that the head 242 bears against the respective one of the legs 226, the tongue 250 pivots through the action of gravity to a position in which it is perpendicular to the longitudinal axis of the shank 241 and thereby locks the lock pin assembly 240 in place. Since the apertures 232 are placed upwardly with respect to the apertures 231 and between the apertures 231 and the bight 227, it is seen that with the lock pin assemblies 240 inserted and in the locking condition thereof, the clamps 210 cannot be pivoted about the pins 211 and, therefore, cannot be moved from their locking position in which they maintain the flexible conduit 130 in position on the support structures 215.

Figure 3:
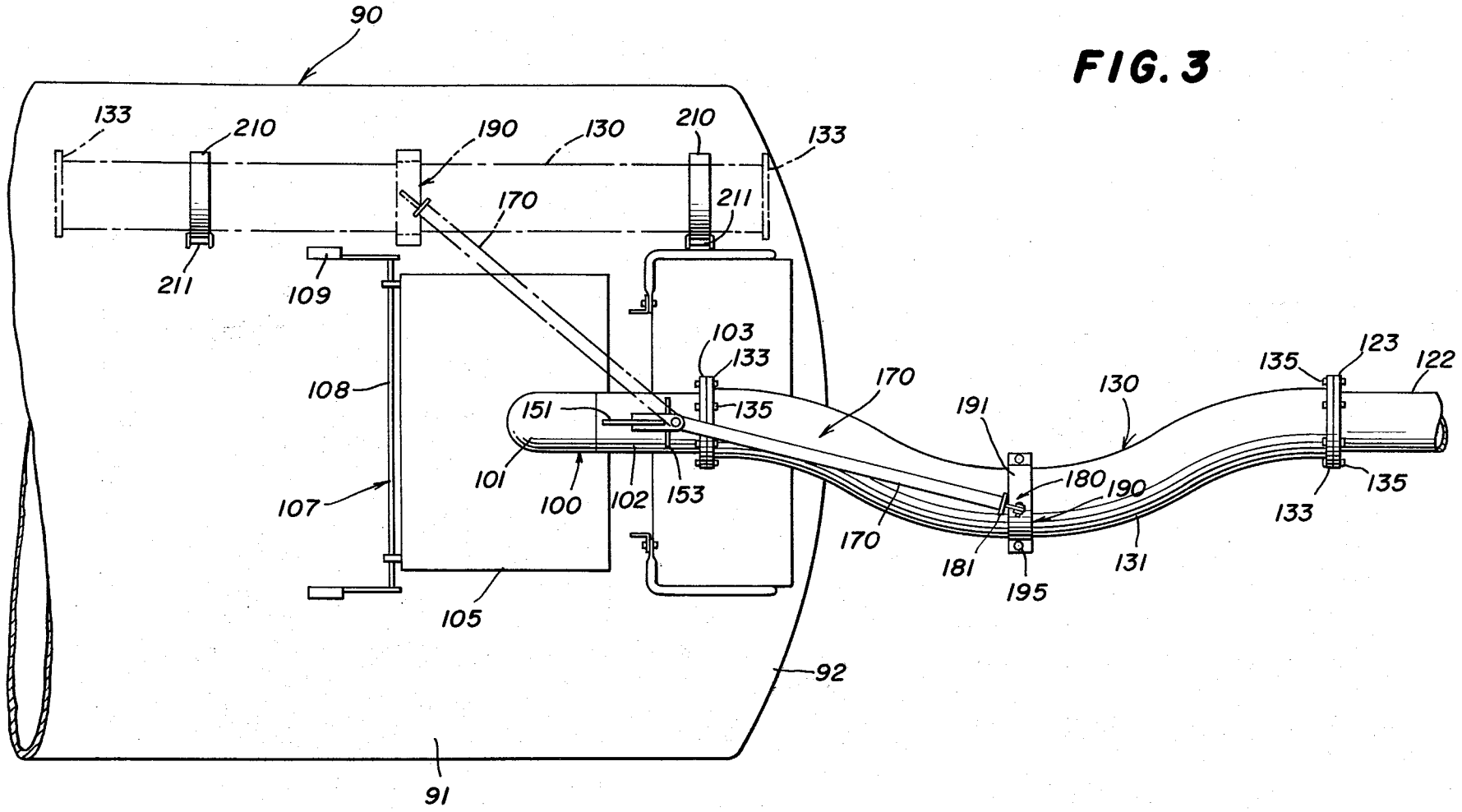
FIG. 3 is a top elevational view of the structure shown in FIG. 2, particularly showing the second position of the crane in phantom.

Referring now specifically to FIG. 3, there are illustrated the two positions of the crane 150 wherein the crane in the full line position thereof supports the associated flexible conduit 130 with the central portion thereof being elevated with respect to the straight pipes 102 and 122 of the associated inlet conduit 100 and the associated outlet conduit 120, respectively. When it is desired to store the flexible conduit 130, such as when the tank car 60 is to be cleaned or otherwise taken out of service, the connectors 135 are disengaged from each of the flanges 133 and thereafter the crane 150 is swung, and more particularly the arm 170 is moved about the hinge pin 172 to the dotted line position thereof shown in the drawings. The flexible conduit 130 is thereafter strapped in place by means of the clamps 210, thereby firmly to position the flexible conduit 130 on the support structure 215. The crane 150 is easily managed by a single employee, thereby saving both time and manpower. Cumbersome structure intermediate the adjacent ends of the tank cars 60 is avoided by use of the present invention, thereby increasing the safety and efficiency of operation. Use of the above-described crane structure has further advantages in that the conduit 130 is firmly and fixedly supported from above while at the same time accommodating swinging movement encountered during operation of the train 50.

In operation, a plurality of tank cars 60 is coupled together to form a train 50, as illustrated in FIG. 1, with the inlet conduits 100 and the outlet conduits 120 of adjacent cars coupled together by means of the flexible connecting conduits 130, in the manner described above, thereby to place the tanks 90 of the cars 60 in fluid communication with one another to form a continuous lading vessel. While three of such interconnected railway cars 60 have been illustrated in FIG. 1, it will be appreciated that the railway train 50 may comprise any number of tank cars 60. When it is desired to fill the tanks 90 of the train 50 with fluid lading, the input end of the train 50 is moved into position adjacent to the associated source of lading 40, which is thereafter attached by suitable mechanism to the adjacent input conduit 100. The output conduit 120 at the other end of the train 50 may be vented to atmosphere or may be coupled to a scrubber 30, or other suitable anit-pollution device. All of the valves (not shown) in the inlet conduits 100 and outlet conduits 120 are opened, thereby to establish continuous communication between the end tank cars 60 of the train 50.

The fluid lading, which is normally liquid lading, is introduced into the first or right-handmost car 60, as illustrated in FIG. 1. When the tank 90 is filled to a predetermined level, the pressure of the vapor therein above the liquid lading will build up and push the liquid lading upwardly through the outlet conduit 120 at the other end of the tank and thence through the flexible connecting conduit 130 and into the next adjacent tank 90 through the inlet conduit 100 thereof. When that next tank 90 is filled to a predetermined level, the liquid lading will flow therefrom to the next succeeding tank and this process will be continued until all of the tanks 90 in the train 50 have been filled to a predetermined level with liquid lading. It will be noted that the entire train 50 can be filled from a single location without moving any of the tank cars 60 or disconnecting them from one another.

Since it is desirable to have all of the liquid lading within the tanks 90 of the train 50 during transportation, the position of the flexible conduits 130 above the respective ends of the inlet conduits 100 and outlet conduits 120 is important. By maintaining the center portions of the flexible conduits 130 elevated in the manner hereinbefore described, expensive and time-consuming procedures to empty the conduits are no longer needed. After the pressures in the individual tanks 90 have been equalized, the lading normally in the flexible conduits 130 will flow out of the conduits into the associated and adjacent tank cars 60, thereby to empty the flexible conduits of all lading.

Maintaining the lading within the individual tank cars 60 is particularly important during the transportation of flammable lading, such as gasoline or other petrochemical products. The above-described structure, and particularly the crane 150, insures that no liquid lading remains in the connecting conduits 130 during movement of the train 50. Use of the crane 150 is particularly advantageous since a single operator can easily handle the flexible conduit 130 and insure that it is in proper position with respect to the adjacent inlet conduit 100 and outlet conduit 120 to insure drainage of the lading into the associated tank cars 60, while at the same time a single operator can easily move to the conduit 130 from the interconnecting position, shown in full line in FIG. 3, to the storage position shown in phantom.

When it is desired to unload the train 50 of tank cars 60, the outlet conduit 120 of one of the end cars, such as the left-hand car in FIG. 1, is connected to a source of pressure. This may be a source of nitrogen or air which is pumped into the tank car 60 through the outlet conduit 120 thereof. The increased pressure in the tank car 60 will drive the lading out through the inlet conduit 100 thereof into the next adjacent tank car 60. The inlet conduit 100 of the right-handmost car in FIG. 1 may be connected to a storage facility and in this manner lading is driven from the left-handmost end car through the entire train 50 and out of the right-hand end car. Alternatively, the loading-unloading apparatus 98 may be connected to a pipe 45 in communication with a storage facility. In this case, lading will exit through the loading-unlading apparatus 98 and be transported by the pipe 45 to the storage facility.

While there has been described what is at present considered to be the preferred embodiment of the present invention, it will be understood that various modifications may be made therein, and it is intended to cover in the appended claims all such modifications as fall within the true spirit and scope of the invention.

What is claimed is:

1. A railway tank car adapted for interconnection in fluid communication with associated like tank cars by flexible connecting conduits for accommodating consecutive loading of fluid ladings, said tank car comprising a wheeled chassis structure provided with chassis coupling means for coupling to the chassis structure, two lading conduits respectively coupled to said tank adjacent to the opposite ends thereof in fluid communication therewith and each extending outwardly therefrom adjacent to the top thereof, a flexible hose for at least one of said lading conduits, conduit coupling means on each of said lading conduits for coupling at the top of said tank to the adjacent end of a flexible hose to place said tank in fluid communication with tanks of adjacent like tank cars, and a crane having one end thereof pivotally mounted on said tank adjacent to one end thereof, means at the other end of said crane connected to said hose, said crane being movable between a first position wherein said other end of said crane extends towards the adjacent coupled tank car and a second position wherein said crane overlies said tank, said crane in the first position thereof supporting said hose during movement of the coupled tank cars and maintaining said flexible hose at an elevation higher than that of the associated conduit coupling means so as to cause the drainage of all the lading from said flexible hose through the associated conduit coupling means and into the connected tanks, said crane in said second position thereof placing said hose for storage on said tank, said flexible hose safely accommodating the relative motions between the adjacent tank cars in transit while maintaining a fluid-tight connection therefor, whereby said tank may be connected to associated like tanks in a series through which fluid lading may flow to accommodate consecutive loading thereof while the position of said lading conduits adjacent to the top of said tank safely accommodates the relative motions between the adjacent tank cars in transit.

2. The railway tank car set forth in claim 1, wherein said means at the other end of said crane includes link mechanism for swingably interconnecting said crane and said flexible hose.

3. The railway tank car set forth in claim 1, wherein said means at the other end of said crane includes a ring for connection to said flexible hose substantially midway between the ends thereof.

4. The railway tank car set forth in claim 1, wherein said crane includes a curved arm having a sufficient longitudinal extent to extend about midway between adjacent tank cars when the tank cars are coupled.

5. The railway tank car set forth in claim 1, and further including storage structure mounted on said tank near said crane for storing said flexible hose when said crane is in the second position thereof and said flexible hose is resting on said storage structure.

6. The railway tank car set forth in claim 1, and further including spaced-apart pivotally mounted clamps on said tank near said crane for storing said flexible hose when said crane is in the second position thereof and said hose is positioned between the adjacent tank surface and said pivotally mounted clamps.

7. A railway tank car train for accommodating consecutive loading of fluid ladings, said train comprising a plurality of railway tank cars connected in tandem relationship, each of said tank cars including wheeled chassis structure provided with chassis coupling means for coupling said cars together, a tank mounted on said chassis structure, two lading conduits respectively coupled to said tank adjacent to the opposite ends thereof in fluid communication therewith and each extending outwardly therefrom adjacent to the top thereof, conduit coupling means at the outer end of each of said lading conduits, a plurality of flexible hoses respectively extending between adjacent coupled ones of said tank cars and coupled to said conduit coupling means thereon at the tops of said tanks to place said tanks in fluid communication with the tanks of adjacent tank cars, and a crane for each of said tank cars, each crane having one end thereof pivotally mounted on the associated tank adjacent to one end thereof, means at the other end of each crane connected to the associated hose, each of said cranes being movable between a first position wherein said other end of said crane extends toward the adjacent coupled tank car and a second position wherein said crane overlies said associated tank, each of said cranes in the first position thereof supporting said associated hoses during movement of the coupled tank cars and maintaining said flexible hoses at an elevation higher than that of the associated conduit coupling means so as to cause the drainage of all the lading from said flexible hoses through the associated conduit coupling means and into the connected tanks, each of said cranes in said second position thereof placing said associated hose for support on said associated tank, and flexible hoses safely accommodating the relative motions between the adjacent tank cars in transit while maintaining a fluid-tight connection therefor, whereby said flexible hoses cooperate with said tanks to form a continuous lading vessel through which fluid lading may flow to accommodate consecutive loading thereof while the position of said lading conduits adjacent to the tops of said tanks permits said flexible hoses safely to accommodate the relative motions between adjacent ones of said tank cars in transit.

8. A railway tank car adapted for interconnection in fluid communication with associated like tank cars by flexible connecting conduits for accommodating consecutive loading of fluid ladings, said tank car comprising a wheeled chassis structure provided with chassis coupling means for coupling to the chassis structure, two lading conduits respectively coupled to said tank adjacent to the opposite ends thereof in fluid communication therewith and each extending outwardly therefrom adjacent to the top thereof, a flexible hose for at least one of said lading conduits, conduit coupling means on each of said lading conduits for coupling at the top of said tank to the adjacent end of a flexible hose to place said tank in fluid communication with tanks of adjacent like tank cars, a support mounted on said tank extending outwardly therefrom for receiving said flexible hose thereon, a plurality of clamps overlying said support with each being pivotally mounted with respect thereto and movable between a receiving position wherein said clamp is spaced away from said support and a locking position wherein one end of said clamp extends past said support, locking mechanism associated with each of said clamps for maintaining said clamp in the locking position thereof, and a crane having one end thereof pivotally mounted on said tank adjacent to one end thereof, means at the other end of said crane connected to said hose, said crane being movable between a first position wherein said other end of said crane extends toward the adjacent coupled tank car and a second position wherein said crane overlies said tank, said crane in the first position thereof supporting said hose during movement of the coupled tank cars and maintaining said flexible hose at an elevation higher than that of the associated conduit coupling means so as to cause the drainage of all the lading from said flexible hose through the associated conduit coupling means and into the connected tanks, said flexible hose safely accommodating the relative motions between the adjacent tank cars in transit while maintaining a fluid-tight connection therefor, said crane in said second position thereof placing said flexible hose for storage on said support when said clamps are in the receiving position thereof, said flexible hose in the storage position thereof being maintained on said support by cooperation of said clamps in the locking position thereof and said locking mechanisms therefor.

9. The railway tank car set forth in claim 8, wherein said support has a surface thereof extending upwardly and outwardly with respect to said tank for receiving said flexible conduit thereon.

10. The railway tank car set forth in claim 8, wherein said support has a surface thereof extending upwardly and outwardly with respect to said tank and an aperture at the distal end in said surface for receiving therein said one end of an associated clamp.

11. The railway tank car set forth in claim 8, wherein each of said clamps is pivotally mounted on an upstanding support member and each of said locking mechanisms is mounted above the clamp pivot to prevent said clamp from moving from the locking position thereof.

12. The railway tank car set forth in claim 8, wherein each of said clamps is pivotally mounted on an upstanding support member and each of said locking mechanisms is mounted above the clamp pivot and toward the associated hose support, each of said locking mechanisms comprise a pin defining a clevis at one end thereof supporting an eccentrically pivoted tongue therebetween, whereby when said pin extends through said upstanding support and said tongue is disposed perpendicularly to the longitudinal axis of said pin said clamp is maintained in the locking position thereof.

* * * * *